US006212831B1

(12) United States Patent
White

(10) Patent No.: US 6,212,831 B1
(45) Date of Patent: Apr. 10, 2001

(54) FOUNDATION INSULATION COVERING

(75) Inventor: James P. White, Muskego, WI (US)

(73) Assignee: Wisconsin Poured Wall Products, Muskego, WI (US)

( * ) Notice: Subject to any disclaimer, the term of this patent is extended or adjusted under 35 U.S.C. 154(b) by 0 days.

(21) Appl. No.: 09/560,085

(22) Filed: Apr. 28, 2000

(51) Int. Cl.[7] ..... E02D 19/00
(52) U.S. Cl. ..... 52/169.14; 22/58
(58) Field of Search ..... 52/169.1, 169.11, 52/169.14, 575, 576, 58, 62, 200; 428/119, 120, 121

(56) References Cited

U.S. PATENT DOCUMENTS

| | | | | |
|---|---|---|---|---|
| 2,743,602 | | 5/1956 | Dunn . | |
| 3,673,750 | | 7/1972 | Bokvisk et al. . | |
| 4,036,673 | | 7/1977 | Murphy et al. . | |
| 4,065,893 | | 1/1978 | Epes . | |
| 4,265,062 | | 5/1981 | Klibofske . | |
| 4,270,321 | | 6/1981 | Fisher . | |
| 4,272,576 | | 6/1981 | Britson . | |
| 4,335,548 | | 6/1982 | Rehbein . | |
| 4,409,766 | | 10/1983 | Blackmore . | |
| 4,711,058 | | 12/1987 | Patton . | |
| 4,815,244 | | 3/1989 | Harrington . | |
| 5,360,295 | | 11/1994 | Isacksen . | |
| 5,535,556 | * | 7/1996 | Hughes, Jr. | 52/169.5 |
| 5,713,696 | * | 2/1998 | Horvath et al. | 52/169.14 X |
| 5,749,182 | | 5/1998 | Vavrinak . | |
| 6,122,887 | * | 9/2000 | Massett et al. | 52/169.14 X |

* cited by examiner

*Primary Examiner*—Richard Chilcot
(74) *Attorney, Agent, or Firm*—Jansson, Shupe & Munger LTD.

(57) ABSTRACT

A method for enclosing a layer of insulation covering a building foundation having a vertical edge, where the layer of insulation has front, back and edge surfaces. The method involves: (1) placing the back surface of the layer of insulation against the foundation such that the edge surface of the insulation is aligned with the edge of the foundation; (2) covering the front surface of the layer of insulation with a first protective cover; and (3) enclosing the edge surface and parts of the front and back surface of the insulation with a second protective cover by positioning a back overlap portion of the second protective cover between the back of the layer of insulation and the foundation and a front overlap portion of the second protective cover between the front of the layer of insulation and the first protective cover, whereby all surfaces of the layer of insulation are enclosed. A system for protecting insulation covering a building foundation is also disclosed.

14 Claims, 5 Drawing Sheets

FOUNDATION INSULATION COVERING

FIELD OF THE INVENTION

This invention is related generally to insulation covering and, more particularly, to coverings for enclosing insulation on the foundation of a building.

BACKGROUND OF THE INVENTION

The installing insulation against the walls and foundations of building structures is well known in the art. Insulation is used to hold heat within a building thereby making heating systems more efficient while at the same time preventing moisture from damaging the walls of a structure.

Recent changes in several state and local building codes have mandated the use of an insulation covering that protects the insulation used on foundations. Such protective covering must extend from the top of the foundation to a certain distance below ground level. An example of a protective covering used to protect foundation insulation is disclosed in U.S. Pat. No. 4,409,766 (Blackmore). While the protective covering in Blackmore protects the face of the insulation layer, no protection is afforded or even suggested for the edge of the insulation that is exposed at the edge of the foundation wall at, for example, a window recess. The same shortcoming is present in U.S. Pat. No. 4,335,548 (Rehbein) which discloses a foundation insulating skirt that protects the face of the insulation while leaving the edge exposed.

A corner piece used to protect the edge of an insulation barrier where two pieces of insulation form a right angle is disclosed in U.S. Pat. No. 4,711,058 (Patton). Although the device in Patton protects the insulation edge when the edge foundation forms a right angle, it does not suggest ways of protecting the edge of a layer of insulation that is exposed because of a window recess or the end of the foundation wall forming any angle other than 90°. An insulation protective covering that would allow for the insulation on the foundation of a building, including all insulation edges to be completely enclosed would be an important improvement in the art.

OBJECTS OF THE INVENTION

It is an object of the invention to provide a method and system of protecting insulation that overcomes some of the shortcomings of the prior art.

It is another object of the invention to provide a method and system of protecting insulation that does not leave any portion of the insulation exposed to environmental elements such as rain, sleet and snow.

Still another object of the invention is to provide a method and system of protecting insulation that is easy to attach.

Yet another object of the invention is to provide a method and system of protecting insulation that is aesthetically pleasing. How these and other objects are accomplished will become apparent from the following descriptions and from the drawings.

SUMMARY OF THE INVENTION

The invention involves a method for enclosing a layer of insulation covering a building foundation having a vertical edge, where the layer of insulation has front, back and edge surfaces, the method comprising: (1) placing the back surface of the layer of insulation against the foundation such that the edge surface of the insulation is aligned with the edge of the foundation; (2) covering the front surface of the layer of insulation with a first protective cover; and (3) enclosing the edge surface and parts of the front and back surface of the insulation with a second protective cover by positioning a back overlap portion of the second protective cover between the back of the layer of insulation and the foundation and a front overlap portion of the second protective cover between the front of the layer of insulation and the first protective cover, whereby all surfaces of the layer of insulation are enclosed.

In one embodiment of the invention, the protective covers are made of polyvinylchloride. In still another embodiment, the layer of insulation and both protective covers extend below ground level.

In a preferred embodiment of the invention, the first protective cover is attached to the foundation. In a specific version of such embodiment, nails are used to attach the first protective cover to the foundation.

In a more preferred embodiment of the invention, the second protective cover has a "J-shaped" edge. In yet another embodiment the layer of insulation is in sheet form. In still another embodiment, the front protective cover has an "L-shaped" edge.

The invention also involves an improved system for protecting insulation covering a building foundation having a vertical edge where the insulation has front and back surfaces and an edge surface aligned with the edge of the foundation and a first protective sheathing covering the front portion, the improvement comprising a second protective cover surrounding the edge surface of the insulation and overlapping the front and back surfaces of the insulation. In one embodiment of the improved system, the second protective cover has a "J-shaped" edge.

In another embodiment of the system, the protective covers are made of polyvinylchloride. While in a preferred embodiment, the layer of insulation and both protective covers extend below ground level.

In a more preferred embodiment of the system, the first protective cover is attached to the foundation. In a specific version of this embodiment, nails are used to attach the first protective cover to the foundation.

BRIEF DESCRIPTION OF THE DRAWINGS

The drawings illustrate preferred embodiments which include the above-noted characteristics and features of the invention. The invention will be readily understood from the descriptions and drawings. In the drawings.

DETAILED DESCRIPTION OF PREFERRED EMBODIMENTS

Figure 1:
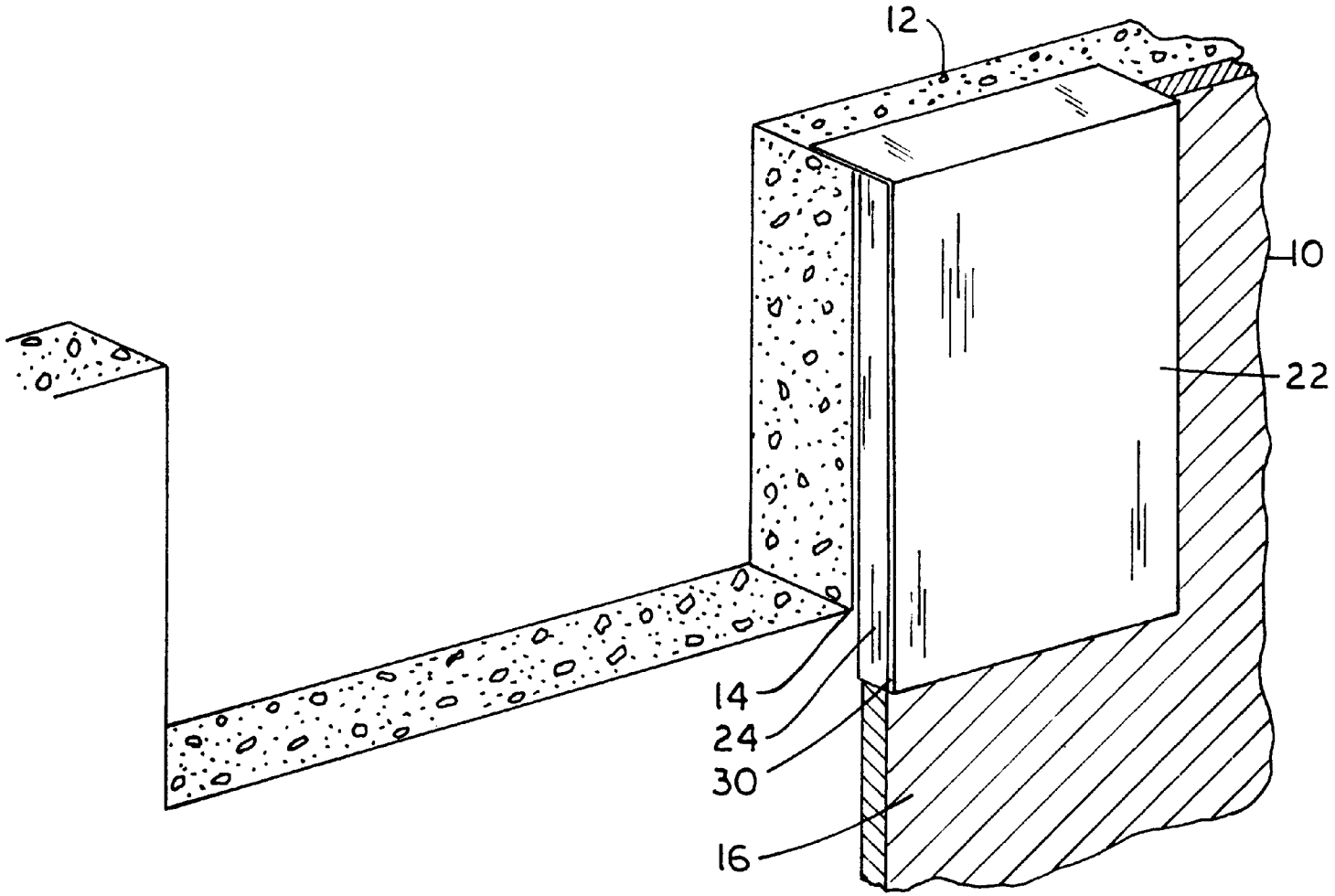
FIG. 1 is a perspective view of a portion of a foundation including an opening for a window showing the second protective cover inserted within the first cover portion thereby enclosing the layer of insulation attached to the outside of the foundation.
Figure 2:
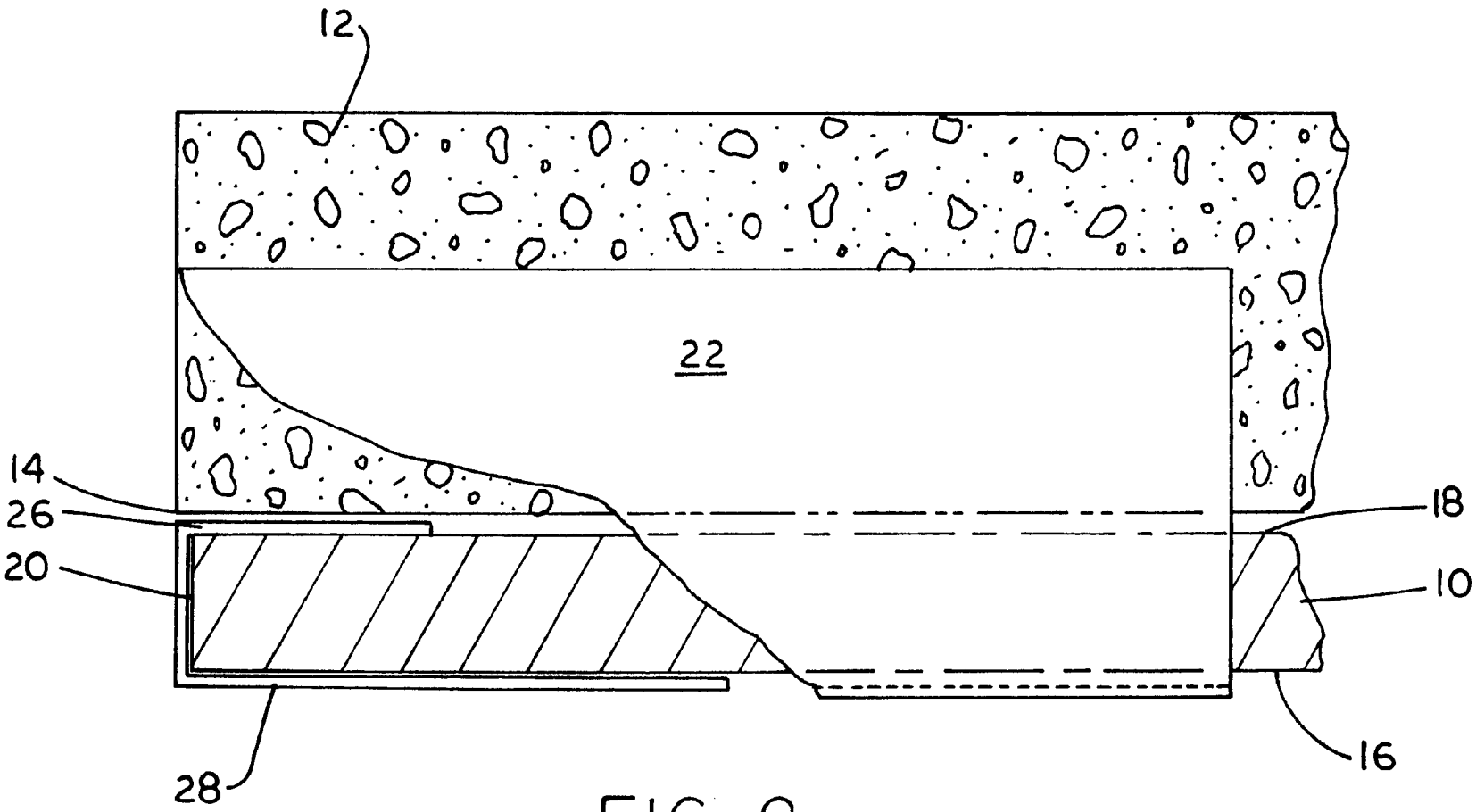
FIG. 2 is a top view of a foundation segment showing a cut-away portion of the first protective covering with the second protective covering enclosing the edge of a layer of insulation.
Figure 3:
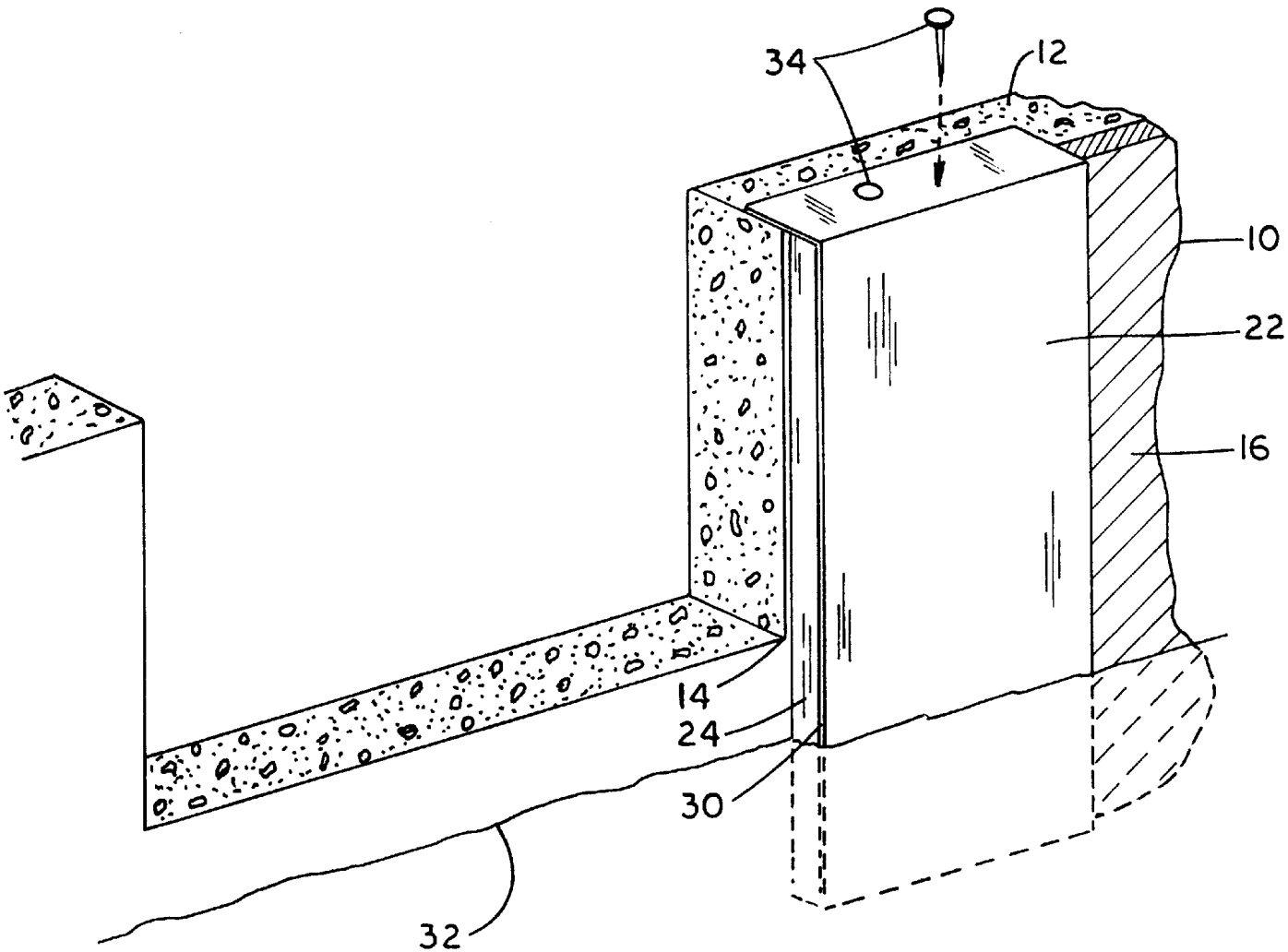
FIG. 3 is a perspective view of a portion of a foundation including an opening for a window showing the second protective cover inserted within the first cover portion thereby enclosing the layer of insulation all of which extend below ground level.

The invention involves a method for enclosing a layer of insulation 10 covering a building foundation 12 having a vertical edge 14, as shown in FIGS. 1–3. The layer of insulation 10 enclosed by the inventive method has front, back and edge surfaces 16, 18, 20, the method comprising the steps of: (1) placing the back surface 18 of the layer of insulation 10 against the foundation 12 such that the edge surface 20 of the insulation 10 is aligned with the edge 14 of the foundation 12; (2) covering the front surface 16 of the layer of insulation 10 with a first protective cover 22; and (3) enclosing the edge surface 20 and parts of the front and back surfaces 18, 20 of the insulation 10 with a second protective cover 24 by positioning a back overlap portion 26 of the second protective cover 24 between the back 18 of the layer of insulation 10 and the foundation 12 and a front overlap portion 28 of the second protective cover 24 between the front 16 of the layer of insulation 10 and the first protective cover 22, whereby all surfaces 16, 18, 20 of the layer of insulation 10 are enclosed.

The placement of the back overlap portion 26 of the second protective cover 24 between the foundation 12 and the layer of insulation 10 and the front overlap portion 28 between the insulation 10 and the first protective cover 22 allows the edge surface 20 of the insulation 10 to be completely enclosed without disrupting the aesthetic appearance of the protective covering 22, 24. This arrangement prevents the seepage of any moisture between the adjoining edges 30 of the protective covering 22, 24.

The protective covering 22, 24 used in the inventive method is made of a weatherproof material that prevents moisture and precipitation such as rain or snow from contacting the layer of insulation 10. In one particular embodiment of the invention, the protective covers 22, 24 are made of polyvinylchloride (PVC). These covers 22, 24 also include an ultraviolet inhibitor that prevents them from being discolored as a result of exposure to sunlight. In a more specific version of this embodiment, the PVC covering has a tensile strength @ 2"/min. of 6,400 psi. and a flexural strength of 12,300 psi. In still another embodiment, as shown in FIG. 3, the layer of insulation 10 and both protective covers 22, 24 extend below ground level 32.

In a preferred embodiment of the invention, the first protective cover 22 is attached to the foundation 12. In a specific version of such embodiment, as shown in FIG. 3, nails 34 are used to attach the first protective cover 22 to the foundation 12.

Figure 4:
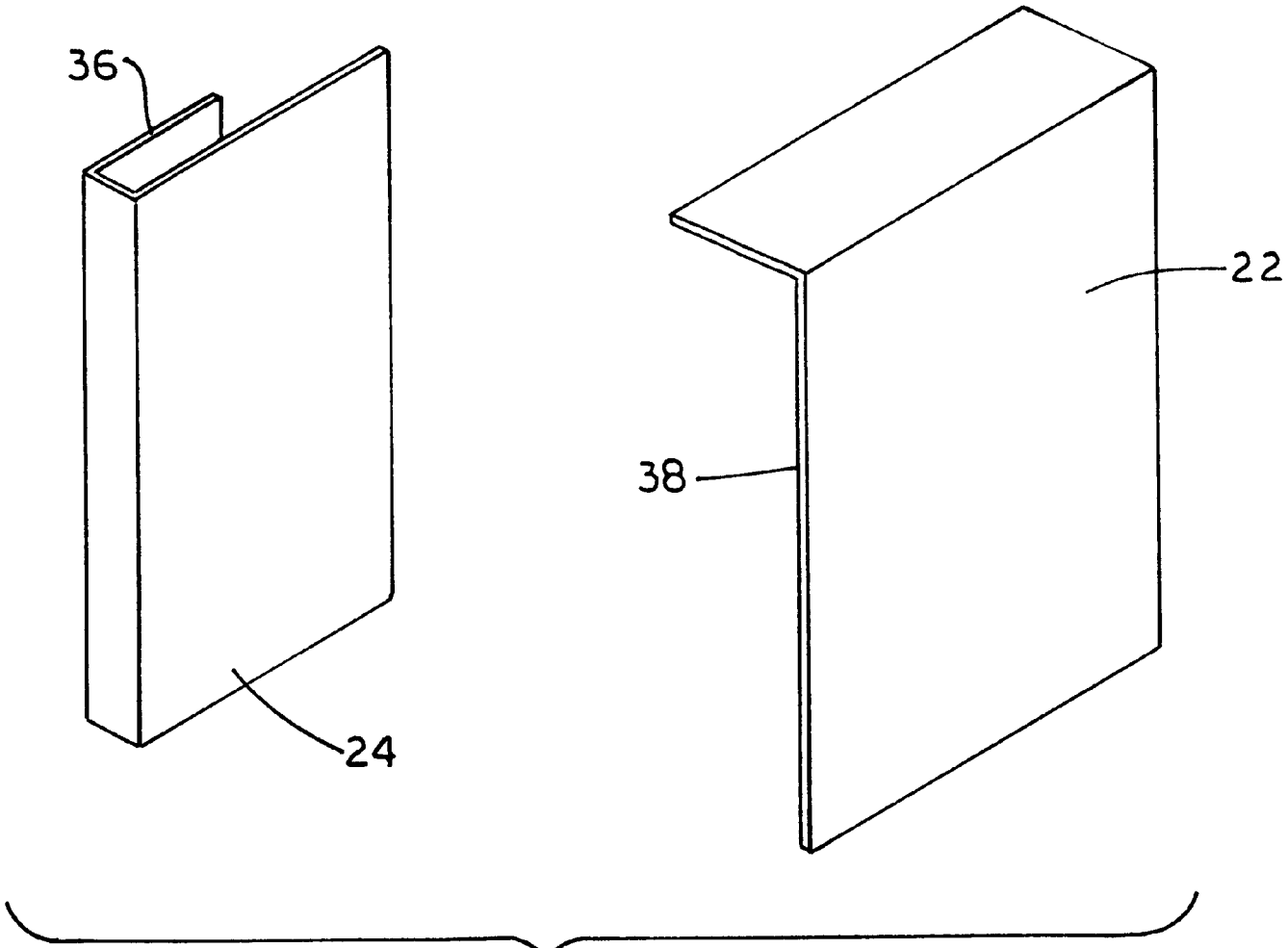
FIG. 4 is a perspective view of the first and second protective coverings.
Figure 5:
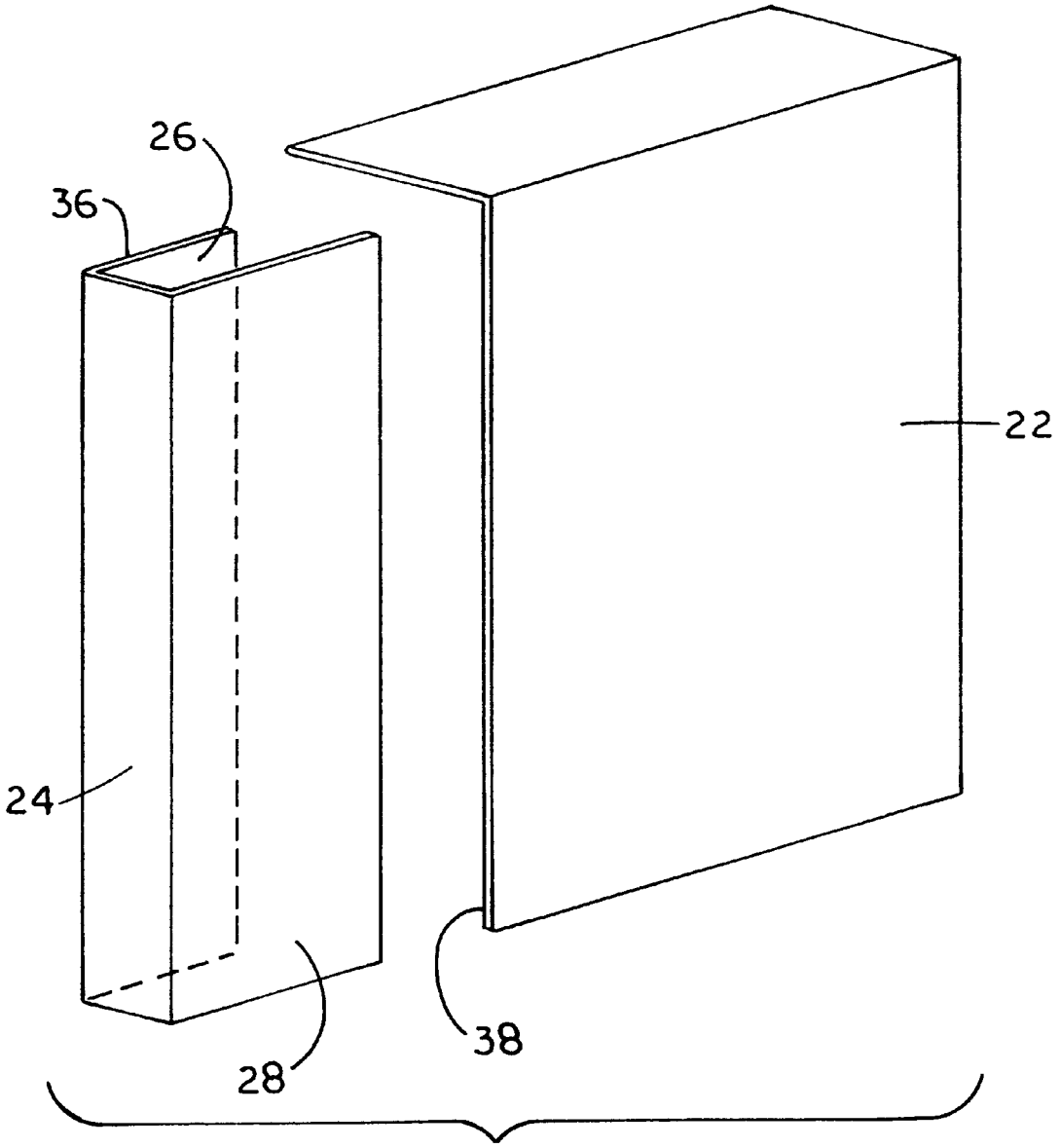
FIG. 5 is a perspective view showing how the first and second covering portions fit together.

FIGS. 4 and 5 show a more preferred embodiment of the invention where the second protective cover 24 has a "J-shaped" edge 36. Such shape allows the second protective cover 24 to completely enclose the edge 20 of the insulation 10. In yet another embodiment the layer of insulation 10 is in sheet form. In still another embodiment, as shown in FIGS. 4 and 5, the first protective cover 22 has a "L-shaped" edge 38.

The invention also involves an improved system for protecting insulation 10 covering a building foundation 12 having a vertical edge 14 where the insulation 10 has front and back surfaces 16, 18 and an edge surface 20 aligned with the edge 14 of the foundation 12 and a first protective sheathing covering 22 the front surface 16, the improvement comprising a second protective cover 24 surrounding the edge surface 20 of the insulation 10 and overlapping the front and back surfaces 16, 18 of the insulation. In a preferred embodiment of the system, the second protective cover 24 has a "J-shaped" edge 36.

In another embodiment of the system, the protective covers 22, 24 are made of polyvinylchloride. As mentioned above, these covers 22, 24 may also have an ultraviolet inhibitor to prevent discoloring as a result of exposure to sunlight. In a preferred embodiment of the system, the layer of insulation 10 and both protective covers 22, 24 extend below ground level 32.

In a more preferred embodiment of the system, the first protective cover 22 is attached to the foundation 12. In a specific version of this embodiment, nails 34 are used to attach the first protective cover 22 to the foundation 12.

While the principles of the invention have been shown and described in connection with but a few embodiments, it is to be understood clearly that such embodiments are by way of example and are not limiting.

What is claimed is:

1. A method for enclosing a layer of insulation covering a building foundation having a vertical edge, where the layer of insulation has front, back and edge surfaces, the method comprising:

placing the back surface of the layer of insulation against the foundation such that the edge surface of the insulation is aligned with the edge of the foundation;

covering the front surface of the layer of insulation with a first protective cover; and enclosing the edge surface and parts of the front and back surfaces of the insulation with a second protective cover by positioning a back overlap portion of the second protective cover between the back of the layer of insulation and the foundation and a front overlap portion of the second protective cover between the front of the layer of insulation and the first protective cover, whereby all surfaces of the layer of insulation are enclosed.

2. The method of claim 1 wherein the protective covers are made of polyvinylchloride.

3. The method of claim 1 wherein the layer of insulation and both protective covers extend below ground level.

4. The method of claim 1 wherein the first protective cover is attached to the foundation.

5. The method of claim 4 wherein nails are used to attach the first protective cover to the foundation.

6. The method of claim 1 wherein the second protective cover has a "J-shaped" edge.

7. The method of claim 1 wherein the layer of insulation is in sheet form.

8. The method of claim 1 wherein the front protective cover has an "L-shaped" edge.

9. An improved system for protecting insulation covering a building foundation having a vertical edge where the insulation has front and back surfaces and an edge surface aligned with the edge of the foundation and a first protective sheathing covering the front portion, the improvement comprising a second protective cover surrounding the edge surface of the insulation and overlapping the front and back surfaces of the insulation.

10. The system of claim 9 wherein the second protective cover has a "J-shaped" edge.

11. The system of claim 9 wherein the protective covers are made of polyvinylchloride.

12. The system of claim 9 wherein the layer of insulation and both protective covers extend below ground level.

13. The system of claim 9 wherein the first protective cover is attached to the foundation.

14. The system of claim 13 wherein nails are used to attach the first protective cover to the foundation.

* * * * *